US009588475B2

(12) United States Patent
Watanabe et al.

(10) Patent No.: US 9,588,475 B2
(45) Date of Patent: Mar. 7, 2017

(54) SHEET TRANSPORT APPARATUS AND IMAGE FORMING APPARATUS

(71) Applicant: CANON KABUSHIKI KAISHA, Tokyo (JP)

(72) Inventors: Kiyoshi Watanabe, Matsudo (JP); Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/954,667

(22) Filed: Nov. 30, 2015

(65) Prior Publication Data

US 2016/0154359 A1 Jun. 2, 2016

(30) Foreign Application Priority Data

Dec. 2, 2014 (JP) ..... 2014-244173
Oct. 22, 2015 (JP) ..... 2015-207950

(51) Int. Cl.

| | |
|---|---|
| ***G03G 15/00*** | (2006.01) |
| ***B65H 7/16*** | (2006.01) |
| ***B65H 5/36*** | (2006.01) |
| ***G03G 21/20*** | (2006.01) |

(52) U.S. Cl.

CPC ..... *G03G 15/6529* (2013.01); *B65H 5/36* (2013.01); *B65H 7/16* (2013.01); *G03G 15/6573* (2013.01); *G03G 21/206* (2013.01)

(58) Field of Classification Search

CPC ..... B65H 5/228; B65H 29/245; B65H 29/58; B65H 29/60; B65H 2406/10; B65H 2406/12; B65H 2513/42; B65H 5/36; B65H 7/16; G03G 15/6529; G03G 15/6573; G03G 21/206

USPC ..... 271/225, 303, 195

See application file for complete search history.

(56) References Cited

U.S. PATENT DOCUMENTS

| | | | | |
|---|---|---|---|---|
| 3,262,699 | A * | 7/1966 | Aschenbrenner | B65H 29/585 226/176 |
| 4,405,126 | A * | 9/1983 | Frye | B65H 29/58 198/438 |
| 4,835,947 | A * | 6/1989 | Langen | B65B 35/30 198/431 |
| 6,116,595 | A * | 9/2000 | d'Agrella | B65H 29/58 271/195 |
| 6,302,392 | B1 * | 10/2001 | Schaefer | B65H 29/60 271/186 |
| 2011/0026995 | A1 * | 2/2011 | Kanda | B65H 29/26 399/407 |
| 2011/0222922 | A1 * | 9/2011 | Kimata | B65H 29/56 399/323 |

FOREIGN PATENT DOCUMENTS

| | | |
|---|---|---|
| JP | 2001255807 A | 9/2001 |
| JP | 2008090198 A | 4/2008 |

* cited by examiner

*Primary Examiner* — David H Bollinger
(74) *Attorney, Agent, or Firm* — Canon U.S.A., Inc. IP Division

(57) ABSTRACT

A sheet transport apparatus includes a transport guide that is included in a first transport path along which a sheet is to be transported and a flapper that selectively guides the sheet, which is transported by passing through the first transport path, to a second transport path and a third transport path. The transport guide has an air-blowing hole that is positioned further upstream than the flapper in a transport direction of the sheet. The sheet transport apparatus further includes an air-blowing fan that blows air to the flapper from outside the first transport path via the air-blowing hole.

12 Claims, 12 Drawing Sheets

SHEET TRANSPORT APPARATUS AND IMAGE FORMING APPARATUS

BACKGROUND OF THE INVENTION

Field of the Invention

The present invention relates to a sheet transport apparatus that includes a plurality of transport paths and a movable guide portion, which guides in such a manner as to perform switching of a transport path along which a sheet is to be transported, and an image forming apparatus.

Description of the Related Art

In general, in an image forming apparatus that employs an electrophotographic system, a configuration is employed in which a toner image, which has been transferred to a sheet by a transfer unit, is fixed onto the sheet by a fixing unit. In the related art, there has been a problem in that a sheet becomes stuck in a transport path (such a phenomenon will hereinafter be referred to as a paper jam) as a result of condensation occurring in an apparatus and in the transport path caused by steam generated by the sheet, to which a toner image has been fixed by a fixing unit. There is known a method of causing air to flow across a transport path, which is used after a toner image has been fixed to a sheet, by disposing an air-blowing fan and an exhaust duct in the transport path and guiding steam to an exhaust duct so as to discharge the steam outside the apparatus in order to prevent the occurrence of a paper jam (Japanese Patent Laid-Open No. 2008-90198).

In addition, there is known a method of holding back steam by using a discharge preventing member and exhausting, by blowing air, steam that has collected in a transport path between a fixing unit and the discharge preventing member in order to prevent the steam from diffusing from an air-blowing exhaust area (Japanese Patent Laid-Open No. 2008-90199).

Furthermore, an apparatus in which a flow-control unit is disposed in such a manner as to face an air-discharge port of an air-cooling unit in order to cool a sheet, to which a toner image has been fixed, the flow-control unit being configured to perform switching of a flow path of air from an air-blowing unit in accordance with an image forming mode for the sheet (two-side mode or normal mode), is disclosed in Japanese Patent Laid-Open No. 2001-255807.

However, in the case where there are a plurality of transport paths used for transporting a sheet, to which a toner image has been fixed, it is necessary to dispose an air-blowing fan and an exhaust duct in each of the transport paths or to dispose communication ducts that connect the plurality of transport paths, an air-blowing fan, and an exhaust duct. If the communication ducts of the plurality of transport paths are in constant communication with the air-blowing fan and the exhaust duct, air will also flow into some of the transport paths that are not used. In the apparatus disclosed in Japanese Patent Laid-Open No. 2001-255807, the air flow path is switched by causing a separation claw member of the flow-control unit to rotate, and the separation claw member is brought into contact with a guide of a transport path, the transport path being formed as a result of a transport path branching into portions. Thus, the air also flows into one of the transport paths that is not used, that is, a transport path along which a sheet is not transported (see FIG. 2 of Japanese Patent Laid-Open No. 2001-255807). Therefore, in order to blow a sufficient amount of air into one of the transport paths that is being used, it is necessary to consider the amount of the air that will flow into the transport path that is not used and to blow more air than necessary, and consequently, the power and the size of the air-blowing fan need to be increased. In other words, there has been a problem in that, when trying to blow air, which is sufficient to exhaust steam, into a plurality of transport paths, the manufacturing costs and the size of an apparatus increase.

The present invention is directed at a sheet transport apparatus that includes a plurality of transport paths and that is capable of blowing air into the plurality of transport paths by employing a simple configuration.

SUMMARY OF THE INVENTION

A sheet transport apparatus according to an aspect of the present invention includes a first transport guide portion that is included in a first transport path along which a sheet is to be transported and a movable guide portion that selectively guides the sheet, which is transported by passing through the first transport path, to a second transport path and a third transport path. The first transport guide portion has a ventilation portion that is positioned further upstream than the movable guide portion in a transport direction of the sheet. The sheet transport apparatus further includes an air-blowing unit that blows air to the movable guide portion from outside the first transport path via the ventilation portion.

Further features of the present invention will become apparent from the following description of exemplary embodiments with reference to the attached drawings.

DESCRIPTION OF THE EMBODIMENTS

First Embodiment

A first embodiment of the present invention will be described in detail below with reference to the drawings.

<Image Forming Apparatus>

Figure 1:
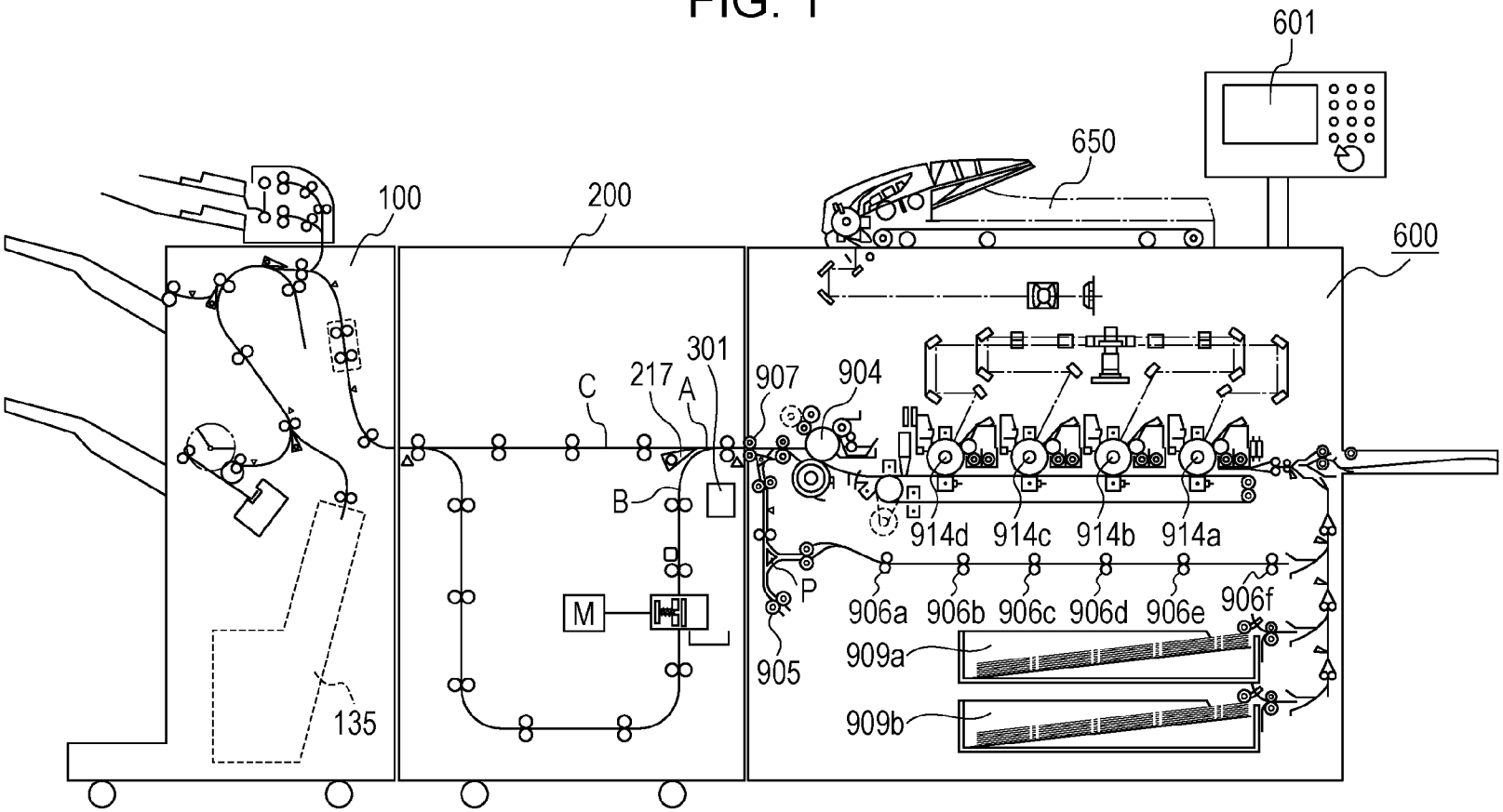
FIG. 1 is a sectional view of an image forming apparatus that includes a sheet transport apparatus.

FIG. 1 is a block diagram of an image forming apparatus and a sheet transport apparatus. As illustrated in FIG. 1, the image forming apparatus includes a main body 600 of the image forming apparatus (hereinafter referred to as apparatus main body 600), which is an image-forming unit that performs image formation, a puncher 200, and a finisher 100. The puncher 200 and the finisher 100 are connected to the apparatus main body 600. With this configuration, a sheet that is ejected from the apparatus main body 600 can be processed by the puncher 200 and the finisher 100, which are connected to the apparatus main body 600. Note that the apparatus main body 600 is configured to be capable of being used by itself without being connected to the puncher 200 or the finisher 100. In addition, in FIG. 1, although the apparatus main body 600, the puncher 200, and the like are configured to be connected to the outside, the apparatus main body 600, the puncher 200, and the finisher 100 may be integrally formed so as to form the image forming apparatus. Here, a position facing an operation unit 601, which is used by a user in order to perform various input and setting operations on the apparatus main body 600, is on the side on which the front surface of the image forming apparatus is present. The side on which the front surface of the image forming apparatus is present will hereinafter be referred to as the front side, and the side on which the rear surface of the image forming apparatus is present will hereinafter be referred to as the back side. FIG. 1 illustrates the configuration of the image forming apparatus as seen from the front side. The puncher 200 and the finisher 100 are connected to a side portion of the apparatus main body 600.

Photoconductor drums 914*a*, 914*b*, 914*c*, and 914*d* each corresponding to one of colors yellow, magenta, cyan, and black, and other members that are included in the image-forming unit transfer toner images of the four colors onto a sheet S, which is fed by one of cassettes 909*a* and 909*b* in the apparatus main body 600. Then, the sheet S is transported to a fixing unit 904, and the toner images are fixed onto the sheet S. In the case of a single-sided image forming mode, the sheet S is ejected as is to outside the apparatus main body 600 by a pair of ejection rollers 907. In the case of a double-sided image forming mode, the sheet S is delivered to reverse rollers 905 from the fixing unit 904, and when a trailing end of the sheet S in a transport direction crosses a reverse-flapper portion P, the reverse rollers 905 are caused to rotate in a reverse direction so as to transport the sheet S in a direction toward two-side transport rollers 906*a* to 906*f*, the direction being the reverse of the transport direction. After that, the photoconductor drums 914*a*, 914*b*, 914*c*, and 914*d*, each of which corresponds to one of the colors yellow, magenta, cyan, and black, and the other members transfer toner images of the four colors again onto the back surface of the sheet S. The sheet S, which has the toner images transferred to the two surfaces thereof, is transported to the fixing unit 904 again, and the toner images are fixed onto the sheet S. Then, the sheet S is ejected to outside the apparatus main body 600 by the pair of ejection rollers 907.

Figure 2:
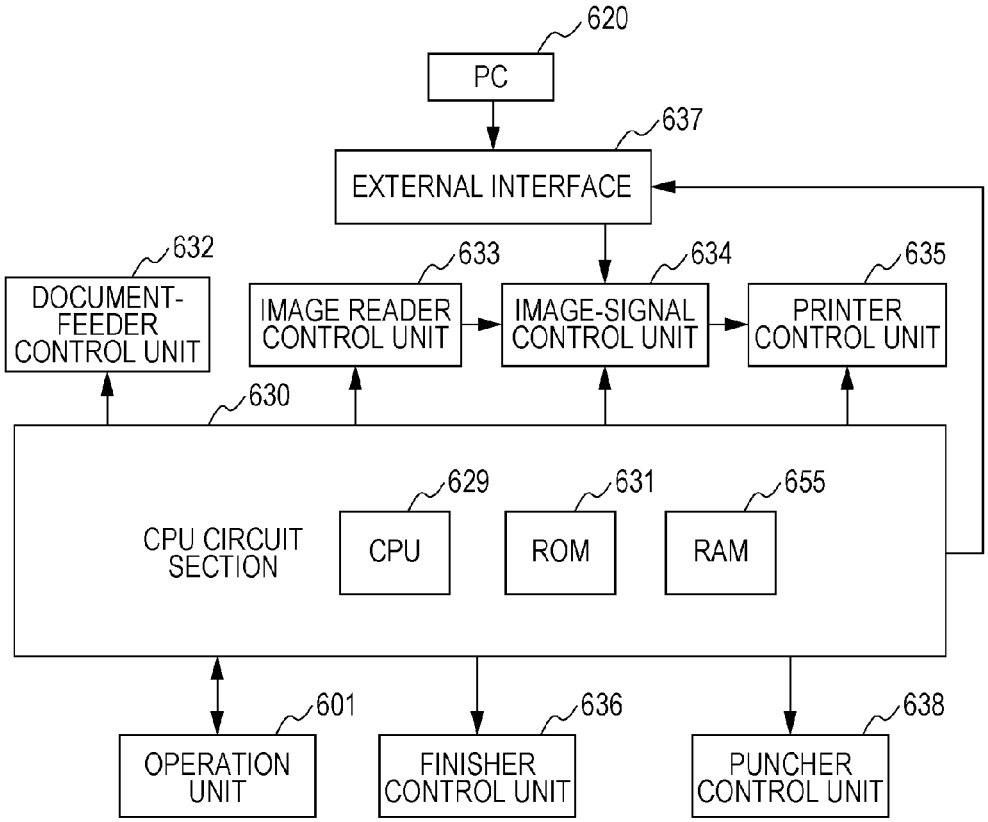
FIG. 2 is a system block diagram.

FIG. 2 is a block diagram of an image-forming-apparatus control unit that controls the image forming apparatus.

A CPU circuit section 630 includes a CPU 629, a ROM 631, and a RAM 655. The CPU circuit section 630 controls a document-feeder control unit 632, an image-reader control unit 633, an image-signal control unit 634, a printer control unit 635, a finisher control unit 636, a puncher control unit 638, and an external interface 637. The CPU circuit section 630 performs control in accordance with programs stored in the ROM 631 and the settings set by using the operation unit 601. The document-feeder control unit 632 controls a document feeder 650. The image-reader control unit 633 controls an image reader. The printer control unit 635 controls the apparatus main body 600. The puncher control unit 638 controls the puncher 200. The finisher control unit 636 controls the finisher 100. Although a configuration in which the puncher control unit 638 and the finisher control unit 636 are respectively mounted in the puncher 200 and the finisher 100 is described in the first embodiment, the present invention is not limited to this configuration. The puncher control unit 638 and the finisher control unit 636 may be integrally formed with the CPU circuit section 630 in the apparatus main body 600, and the puncher 200 and the finisher 100 may be controlled by the apparatus main body 600.

The RAM 655 is used as an area in which control data is to be temporarily stored or a work area for calculations associated with control. The external interface 637 is an interface for a computer (PC) 620 and outputs print data to the image-signal control unit 634 after expanding the print data into an image. An image read by an image sensor is output to the image-signal control unit 634 from the image-reader control unit 633, and the image that has been output to the printer control unit 635 from the image-signal control unit 634 is input to an exposure control unit.

The puncher control unit 638 is mounted in the puncher 200 and performs drive control of the entire puncher 200 by exchanging information with the CPU circuit section 630 of the image forming apparatus. The finisher control unit 636 is mounted in the finisher 100 and performs drive control of the entire finisher 100 by exchanging information with the CPU circuit section 630 of the image forming apparatus. The puncher control unit 638 and the finisher control unit 636 control various motors and sensors.

<Puncher>

Figure 3:
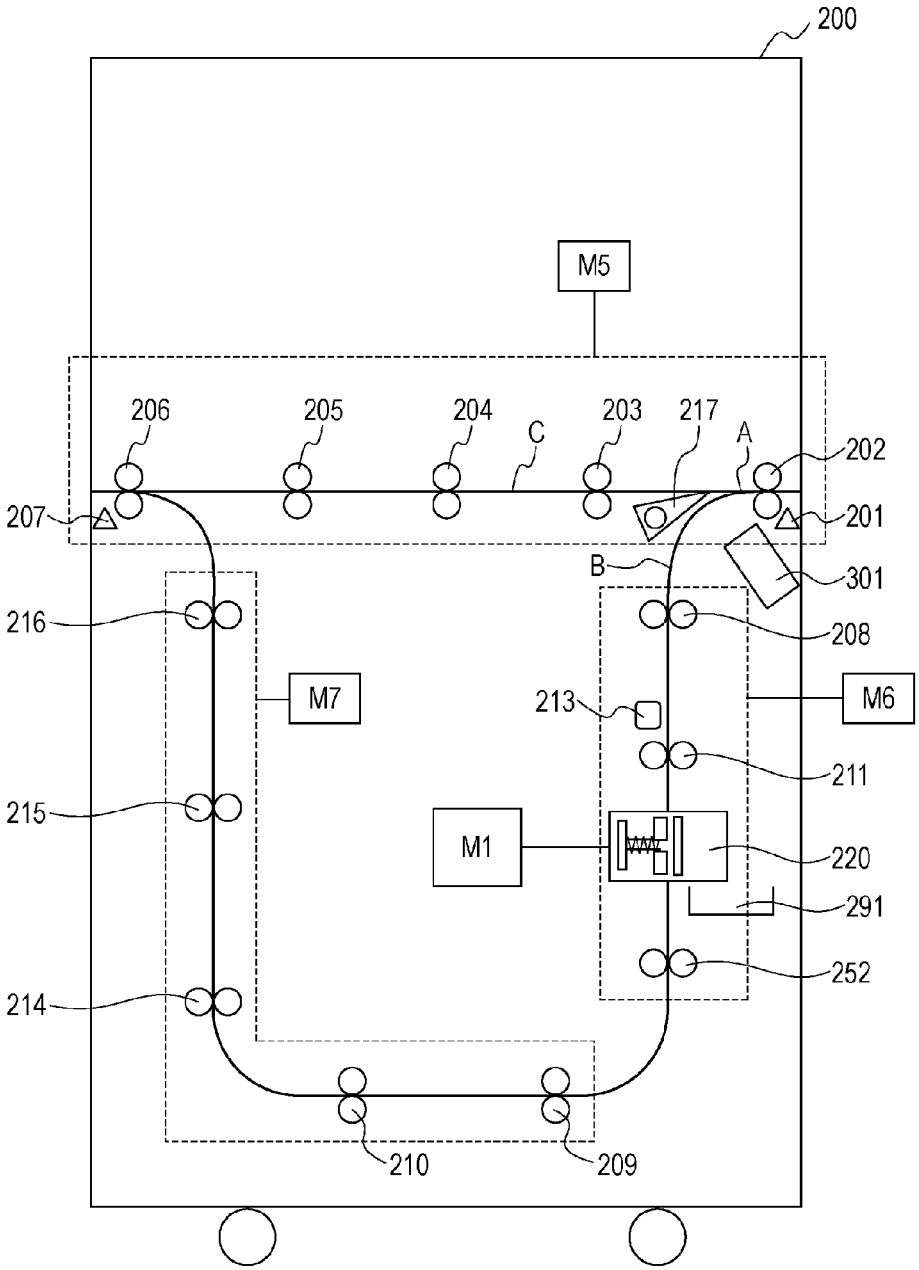
FIG. 3 is a sectional view illustrating a puncher.

FIG. 3 is a sectional view of the puncher 200. The puncher 200 sends a sheet that has been ejected from the apparatus main body 600 to a transport path A (first transport path). The sheet, which has been sent to the transport path A, is selectively transported to a punch path B (second transport path) that is used when a punching operation is performed on the sheet or a bypass C (third transport path) that is used when the sheet is delivered to the finisher 100, which is located on a downstream side, without performing the punching operation. A transport path along which the sheet, which has passed through the transport path A, is to be transported is selectively switched between the punch path B and the bypass C by a flapper 217 that is a movable guiding member.

In the puncher 200, sheet processing is performed in accordance with the settings set by a user by using the operation unit 601, which is included in the apparatus main body 600.

A sheet ejected from the apparatus main body 600 is delivered to a pair of inlet rollers 202 of the puncher 200. At the same time, the timing at which the sheet is delivered is sensed by an entry sensor 201.

In the case where the sheet does not undergo any processing, the sheet is guided to the bypass C by the flapper 217, transported by pairs of transport rollers 203, 204, and 205 and a pair of ejection rollers 206, and delivered to the finisher 100 located on the downstream side.

In the case where the sheet undergoes the punching operation, the transport path is switched to the punch path B by the flapper 217. The sheet is transported to a processing section by pairs of transport rollers 208, 211, and 252. An end of the sheet is detected by a sheet-end detection sensor 213. Then, the sheet that has been transported to a predetermined position in the transport direction is perforated by a punching unit 220. The sheet, which has been perforated, is transported again by pairs of transport rollers 209, 210, 214, 215, and 216 and the pair of ejection rollers 206 and delivered to the finisher 100 located on the downstream side.

Figure 4:
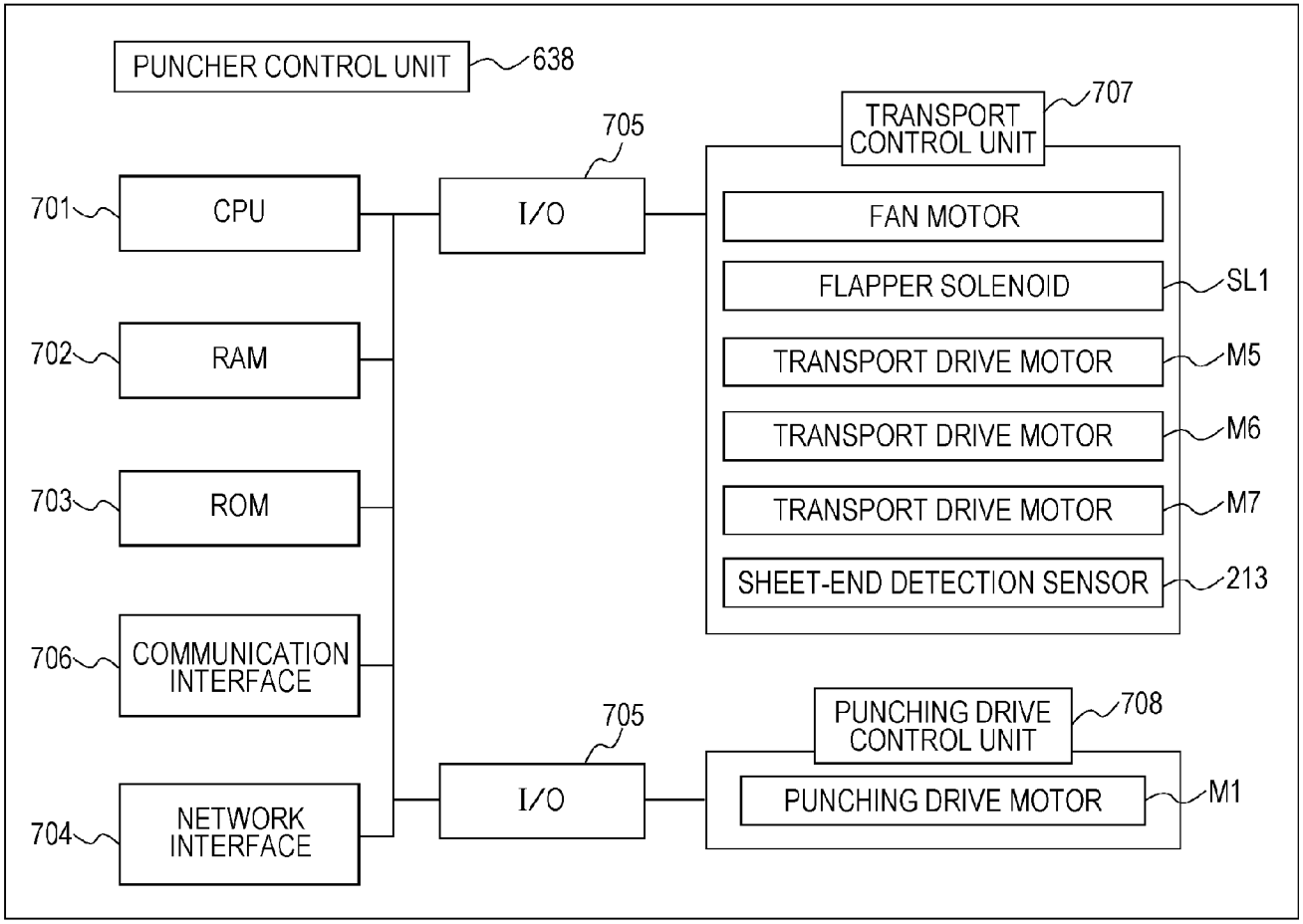
FIG. 4 is a control block diagram of the puncher.

FIG. 4 is a control block diagram of the puncher 200. The puncher control unit 638 includes a microcomputer (CPU) 701, a RAM 702, a ROM 703, an input/output section 705 (hereinafter referred to as I/O 705), a communication interface 706, and a network interface 704. A transport control unit 707 controls a flapper solenoid SL1 that drives the flapper 217, transport motors M5, M6, and M7, and an air-blowing fan 301. A punching drive control unit 708 controls a punching drive motor M1. Various sensor signals are input to an input port of the I/O 705. Driving systems are connected to an output port of the I/O 705 via a control block (not illustrated) and various drivers (not illustrated).

<Description of Punching Mode Operation>

Figure 5:
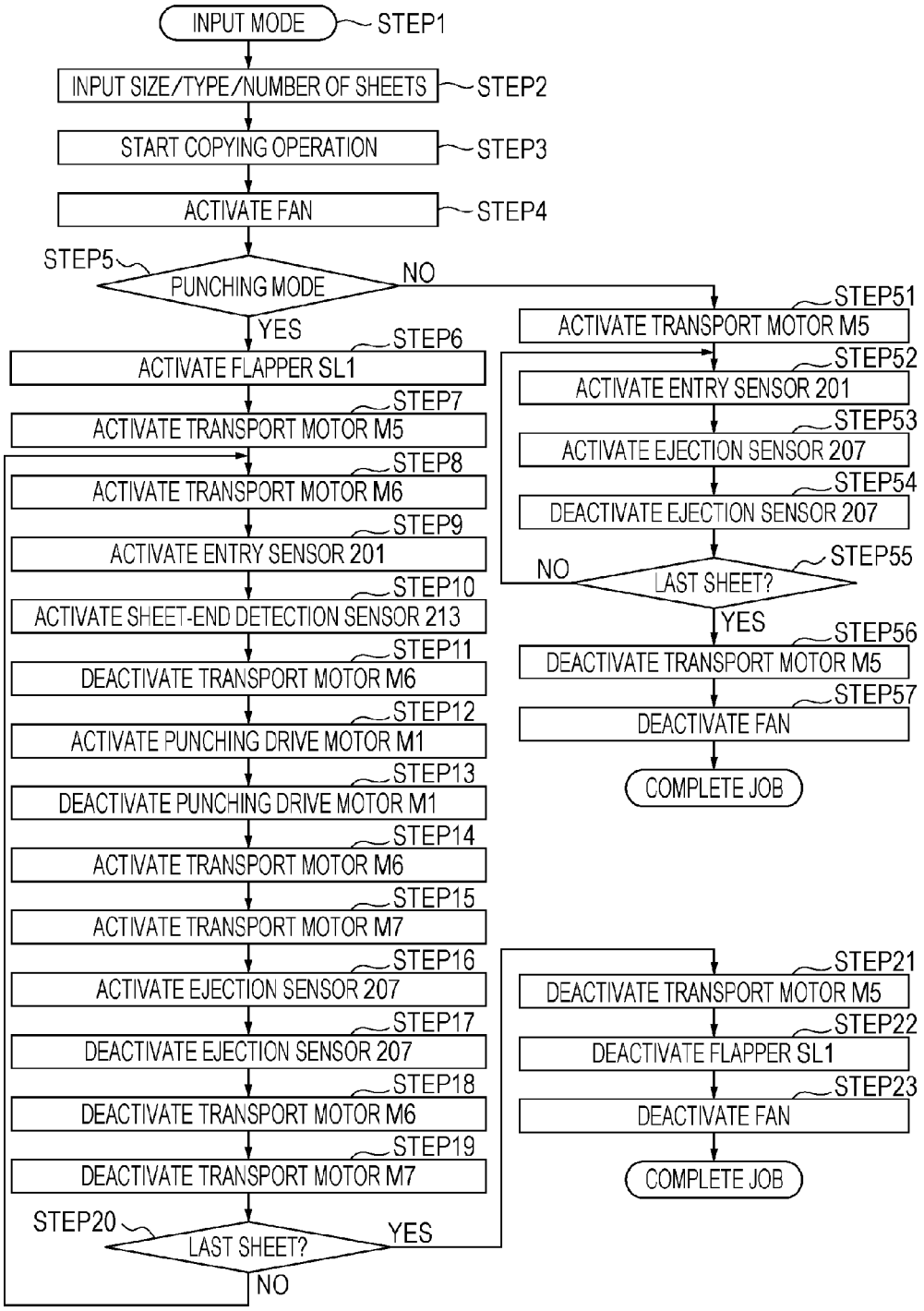
FIG. 5 is a flowchart of an operation.

An operation in a punching mode for performing a punching operation on a sheet will now be described with reference to the flowchart illustrated in FIG. 5.

A print job is started after selecting a processing mode by using the operation unit 601 (STEP 1), selecting the size, number, and type of sheets to be supplied (STEP 2), and starting a copying operation (STEP 3). The air-blowing fan 301 of the puncher 200 is activated (STEP 4). In the case where the punching mode has been selected (YES in STEP 5), the flapper solenoid SL1 is activated, and a transport path is switched to the punch path B (STEP 6). The transport motor M5 is driven, and the pair of inlet rollers 202, the pairs of transport rollers 203, 204, and 205, and the pair of ejection rollers 206 are caused to rotate (STEP 7). Then, the transport motor M6 is driven, and the pairs of transport rollers 208, 211, and 252 are caused to rotate (STEP 8). After a sheet has been delivered to the puncher 200 from the apparatus main body 600, the entry sensor 201 is activated (STEP 9). Next, once an end of the sheet, which has been transported, has been detected by the sheet-end detection sensor 213 (STEP 10), the sheet is transported by a predetermined distance and caused to stop (STEP 11). As a result, a punch-hole position in a sheet transport direction is determined. Subsequently, the punching drive motor M1 is driven so as to make one rotation at a predetermined punching speed, and the punching operation is performed (STEP 12 and STEP 13). After that, the transport motor M6 and the transport motor M7 are driven, and the pairs of transport rollers 208, 211, 252, 209, 210, and 214 to 216 are caused to rotate (STEP 14 and STEP 15) so as to transport the sheet. The sheet is delivered to the finisher 100 from the puncher 200. An ejection sensor 207 senses the state where the ejection of the sheet to outside the puncher 200 has been completed (STEP 16 and STEP 17). Then, the transport motor M6 and the transport motor M7 are deactivated, and rotations of the pairs of transport rollers 208, 211, 252, 209, 210, and 214 to 216 are stopped (STEP 18 and STEP 19). In the case where the sheet is not the last sheet, STEP 8 to STEP 19 are repeated (STEP 20). In the case where the sheet is the last sheet, the print job is completed after deactivating the transport motor M5 (STEP 21), deactivating the flapper solenoid SL1 (STEP 22), and deactivating the air-blowing fan 301 (STEP 23).

<Description of Through Mode Operation>

An operation in a through mode for a sheet will now be described. The through mode is a mode that is selected in the case of sending a sheet that does not undergo the punching operation to the bypass C. Since the length of the bypass C is smaller than that of the punch path B, in the case where the through mode is selected, the time taken for the sheet to be ejected is short.

A print job is started after selecting a processing mode by using the operation unit 601 (STEP 1), selecting the size, number, and type of sheets to be supplied (STEP 2), and starting a copying operation (STEP 3). The air-blowing fan 301 of the puncher 200 is activated (STEP 4). In the case where the through mode has been selected (NO in STEP 5), the flapper solenoid SL1 will not be activated, and the transport path will not be switched to the punch path B from the bypass C. The transport motor M5 is activated, and the pair of inlet rollers 202, the pairs of transport rollers 203, 204, and 205, and the pair of ejection rollers 206 are caused to rotate (STEP 51). After a sheet has been delivered to the puncher 200 from the apparatus main body 600, the entry sensor 201 turns on (STEP 52). The sheet passes through the bypass C, and the ejection sensor 207 senses the state where the ejection of the sheet to outside the puncher 200 has been completed (STEP 53 and STEP 54). In the case where the sheet is not the last sheet, STEP 52 to STEP 54 are repeated (STEP 55). In the case where the sheet is the last sheet, the print job is completed after deactivating the transport motor M5 (STEP 56) and deactivating the air-blowing fan 301 (STEP 57).

<Description of Air-Blowing Unit of Sheet Transport Apparatus>

Figure 6:
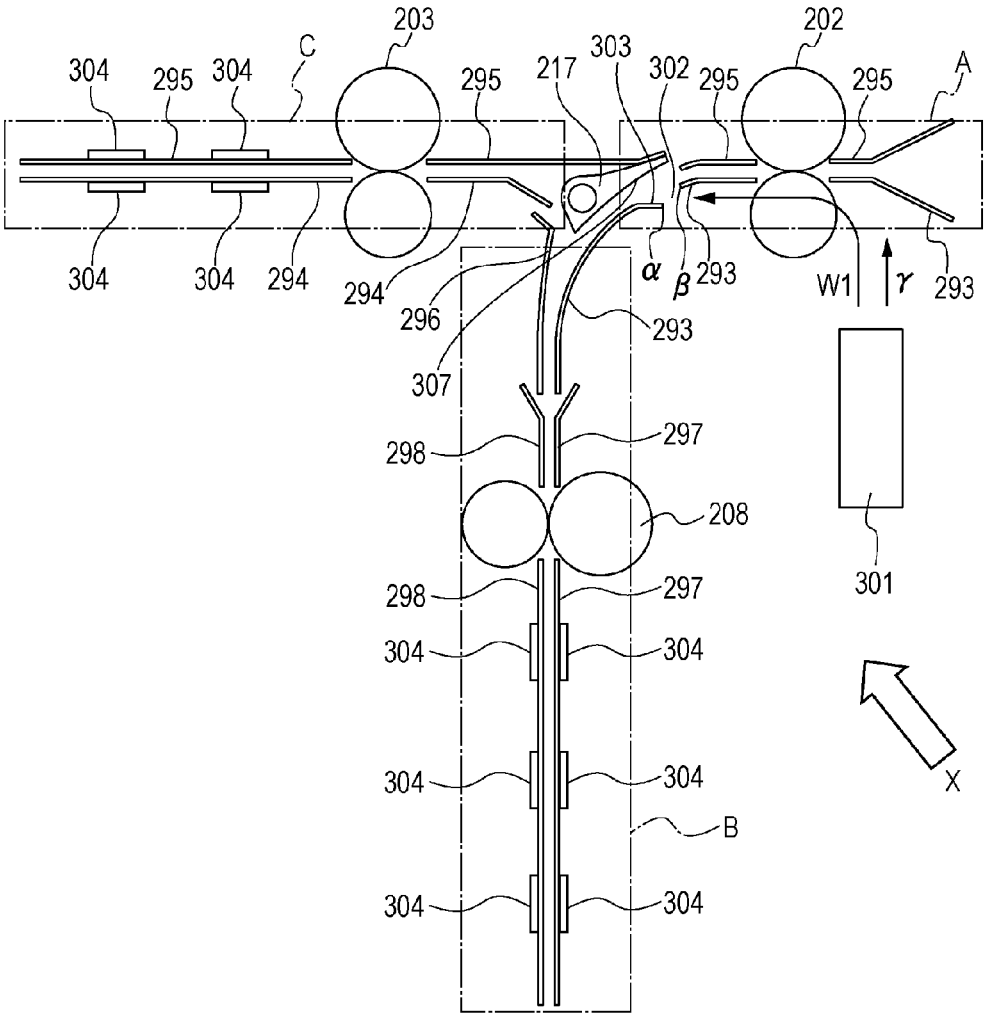
FIG. 6 is a diagram illustrating an air-blowing unit of a transport device according to a first embodiment (air flows into a punch path).
Figure 7:
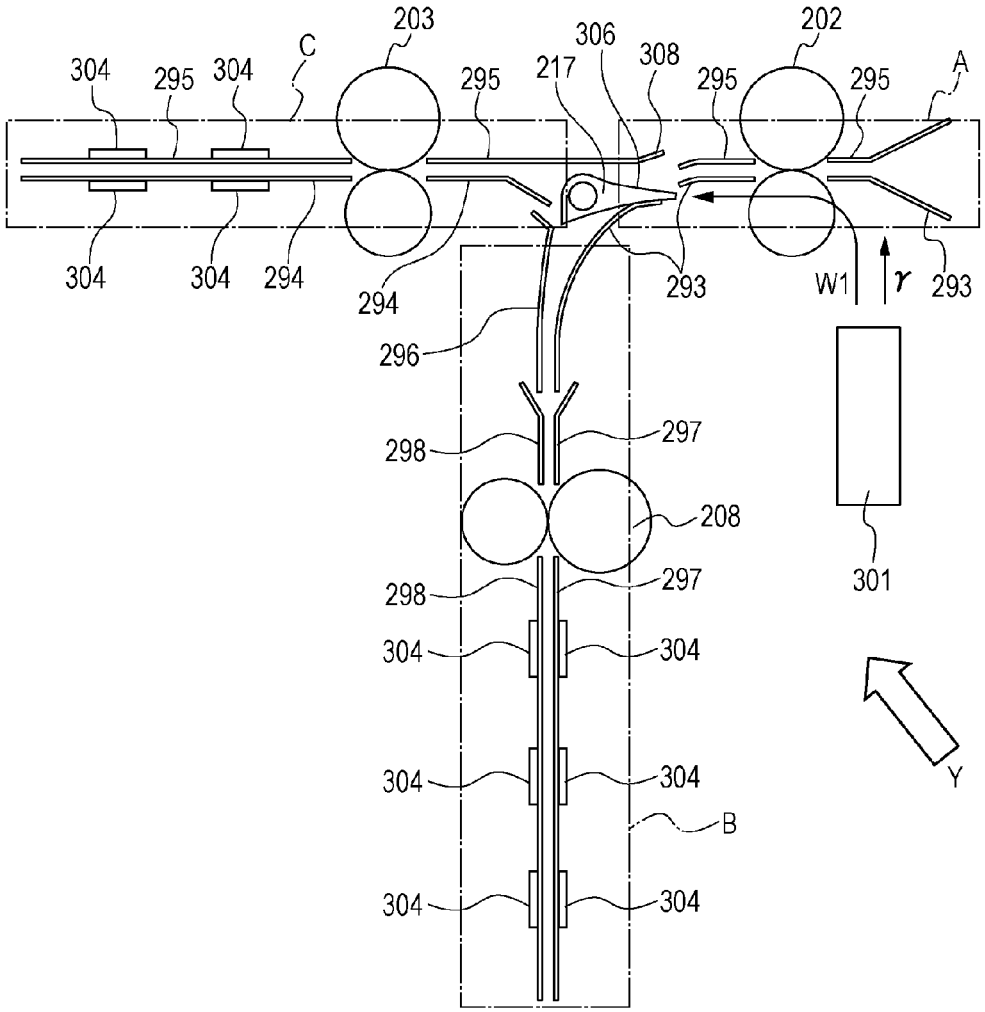
FIG. 7 is a diagram illustrating the air-blowing unit of the transport device according to the first embodiment (air flows into a bypass).

FIG. 6 and FIG. 7 are diagrams each illustrating the configuration of an air-blowing unit of a sheet transport apparatus.

The sheet transport apparatus of the first embodiment is the puncher 200. The puncher 200 switches between the punch path B in which a sheet, which has been transported, undergoes the punching operation and the bypass C through which the sheet passes as is. The puncher 200 includes the transport guide 293 and the like, which are included in the transport path A, the punch path B, and the bypass C, and the flapper 217.

The transport path A includes the transport guide 293 and a transport guide 295, which are first guide portions. The punch path B includes the transport guide 293, and transport guides 296, 297, and 298, which are second guide portions. The bypass C includes a transport guide 294 and the transport guide 295, which are third guide portions. In FIG. 6 and FIG. 7 (also in FIG. 11 and FIG. 12, which will be described later), the transport path A, the punch path B, and the bypass C are indicated by one dot chain lines. As is clear from FIG. 6 and FIG. 7, a portion of the transport guide 293 forms a portion of the transport path A, and another portion of the transport guide 293 forms a portion of the punch path B. Similarly, a portion of the transport guide 295 forms a portion of the transport path A, and another portion of the transport guide 295 forms a portion of the bypass C.

The transport guide 293, which is the first guide portion, has an air-blowing hole (ventilation portion) 302 that is positioned further upstream than the flapper 217 in the sheet transport direction. Air blown by the air-blowing fan (air-blowing unit) 301, which is disposed outside the transport path A, flows into the transport path A via the air-blowing hole 302. Note that an area between the transport guides 293 and 295 through which a sheet is transported will be referred to as an area inside the transport path A, and other areas will be referred to as an area outside the transport path A. The flapper 217 has a rotation-supporting axis, which is positioned further downstream than the air-blowing hole 302 in the sheet transport direction, and performs switching of the sheet transport path between the punch path B and the bypass C as a result of rotating. In other words, the flapper 217 is arranged so as to be capable of moving to a first position at which the sheet transport path is switched to the punch path B (see FIG. 6) and to a second position at which the sheet transport path is switched to the bypass C (see FIG. 7).

FIG. 6 illustrates the case of the punching mode, and in FIG. 6, the sheet transport path has been switched to the punch path B by the flapper 217. As illustrated in FIG. 6, the air W1 blown by the air-blowing fan (air-blowing unit) 301, which is disposed outside the transport path A, comes into contact with the transport guide 293 in such a manner as to flow along the transport guide 293 and flows into the transport path A via the air-blowing hole 302. Regarding the transport guide 293 that forms the air-blowing hole 302, a portion on the downstream side in the sheet transport direction will be referred to as an air-blowing-hole downstream portion α, and a portion on the upstream side in the sheet transport direction will be referred to as an air-blowing-hole upstream portion β. The air-blowing-hole downstream portion α is provided in such a manner that the air-blowing-hole downstream portion α is positioned closer to the air-blowing fan 301 than the air-blowing-hole upstream portion β in a direction in which a flow path γ of the air W1 extends, the air being blown by the air-blowing fan 301. In other words, the air-blowing-hole downstream portion α and the air-blowing-hole upstream portion β form a step. Here, the flow path γ of the air W1 refers to a flow path of the air W1 that has just been blown by the air-blowing fan 301 and does not refer to a flow path of the air W1 after changing its flow direction by coming into contact with the transport guide 293. Thus, the air W1 from the air-blowing fan 301 comes into contact with the transport guide 293, flows along the transport guide 293, and flows into the transport path via the air-blowing hole 302. A top surface of an upstream end of the flapper 217 is in contact with the transport guide 295, and the air W1, which has been blown, is caused by the flapper 217 to flow only into the punch path B, that is, the air W1 is blown concentrically into a transport path used for transporting a sheet. Then the air W1 is exhausted to outside the transport path from exhaust holes (first exhaust ports) 304 formed in transport guides 297 and 298. As a result, air containing steam discharged by the sheet in the transport path is exhausted to outside the transport path, and condensation is prevented from occurring.

FIG. 7 illustrates the case of the through mode, and in FIG. 7, the sheet transport path has been switched to the bypass C by the flapper 217. A bottom surface of the upstream end of the flapper 217 is in contact with the transport guide 293, and the air W1 blown by the air-blowing fan 301 will not flow into the punch path B and is blown concentrically into the bypass C used for transporting a sheet. Then, the air W1 is exhausted to outside the transport path from other exhaust holes 304 formed in the transport guides 294 and 295. As a result, air containing steam discharged by a sheet in the transport path is exhausted to outside the transport path, and condensation is prevented from occurring.

Figure 8:
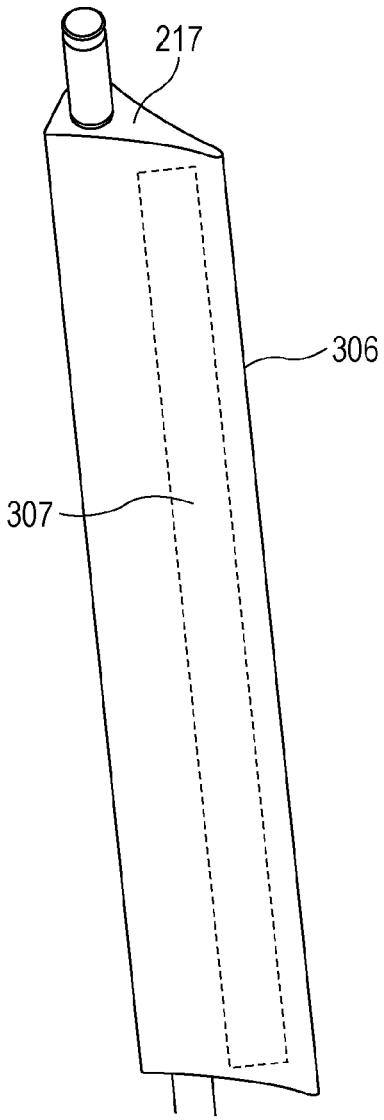
FIG. 8 is a perspective view of a flapper according to the first embodiment.
Figure 9:
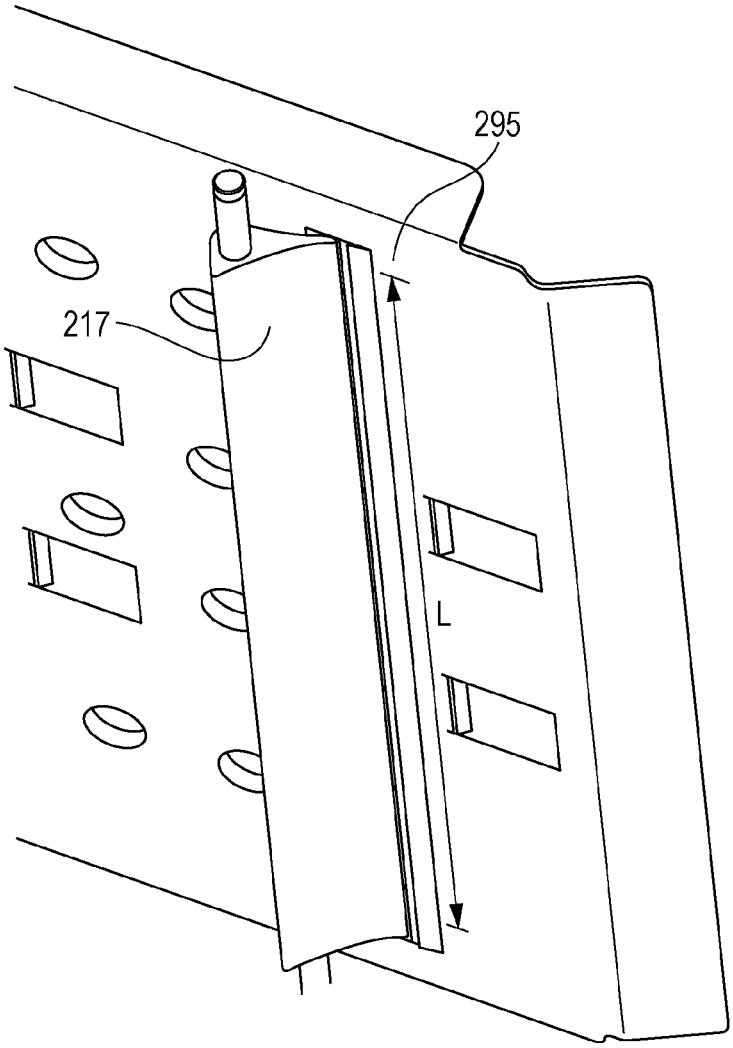
FIG. 9 is a perspective view of FIG. 6 when viewed from the direction of arrow X.
Figure 10:
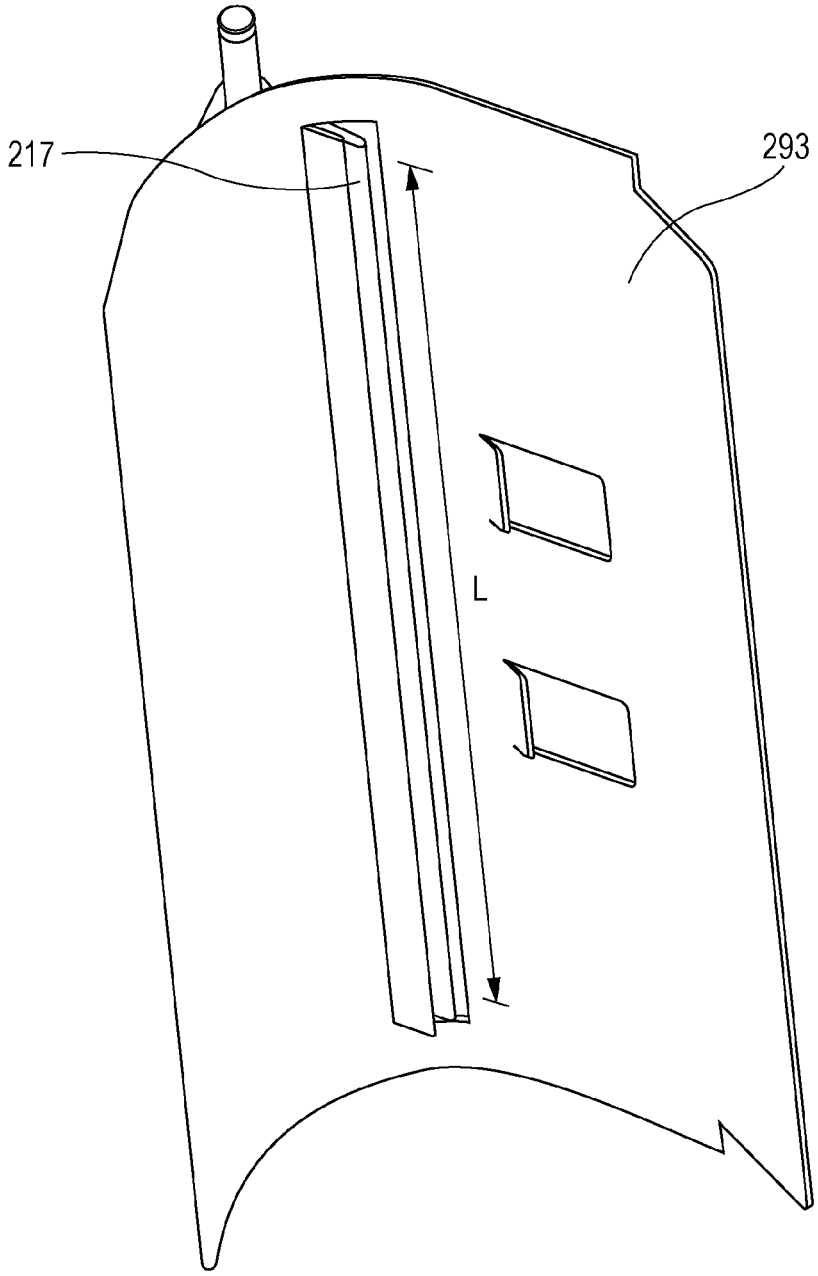
FIG. 10 is a perspective view of FIG. 7 when viewed from the direction of arrow Y.

FIG. 8 is a perspective view of the flapper 217. FIG. 9 is a diagram illustrating a state where the transport guide 295 and the flapper 217 are in contact with each other and is a view of FIG. 6 when viewed from the direction of arrow X. Note that the transport guide 293 is not illustrated in FIG. 9. FIG. 10 is a diagram illustrating a state where the transport guide 293 and the flapper 217 are in contact with each other and is a view of FIG. 7 when viewed from the direction of arrow Y.

Transport surfaces 306 and 307 of the flapper 217 are plane surfaces in a direction perpendicular to the sheet transport direction (a direction perpendicular to FIG. 6 and FIG. 7) and have no unevenness. In addition, surfaces 303 and 308 that are respectively brought into contact with the transport surfaces 307 and 306 are also plane surfaces and have no unevenness. Thus, the flapper 217 and the transport guide 293 (295) come into surface contact with each other, and a gap is less likely to be formed between the flapper 217 and the transport guide 293 (295). This reduces the probability of the air W1, which is blown, leaking out from a transport path that requires the air W1. Projections and depressions, such as ribs, that reduce transport resistance may be formed on and in a portion of the flapper 217 that will not come into contact with the transport guide 293 or 295 and portions of the transport guides 293 and 295 that will not come into contact with the flapper 217.

If a sheet is cooled, steam becomes less likely to be generated by the sheet, and thus, the transport guides 293 to 298 are made of iron. On the other hand, the flapper 217 is made of an aluminum material that has a thermal conductivity larger than that of iron. This facilitates absorption of heat from a sheet by the flapper 217 during the period when the sheet is transported while being in contact with the flapper 217. Although the temperature of the flapper 217 is increased after the flapper 217 has absorbed the heat from the sheet, the flapper 217 will be easily cooled as a result of the air W1 blown by the air-blowing fan 301 removing the heat from the flapper 217. From the standpoint of cooling a sheet, a sheet may be more effectively cooled by making the transport guides 293 to 298, each of which is generally made of iron or a resin, by using a material (aluminum) having a large thermal conductivity compared with the case where only the flapper 217 is made of an aluminum material. However, the manufacturing costs increase as a result of using such a material (aluminum) having a large thermal conductivity. Therefore, only the flapper 217, which will be easily cooled as a result of being exposed to the air W1 after absorbing the heat from the sheet, is made of a material (aluminum) having a large thermal conductivity, so that a high degree of cost effectiveness is achieved.

The flapper 217 is continuously formed in the direction perpendicular to the sheet transport direction. When the direction perpendicular to the sheet transport direction is a sheet width direction, the flapper 217 is formed in such a manner that the length of the flapper 217 in the sheet width direction is at least larger than the maximum length L in the lateral direction of a sheet, which is transported along the transport path A. With this configuration, the sheet comes into contact with the flapper 217 that has been cooled by the air W1, which is blown, and the sheet is cooled.

As described above, as a result of the flapper 217, which performs switching of a transport path, also serving as a unit that performs switching of an air flow path, even in the case where a plurality of transport paths are formed, it is not necessary to dispose a fan in each of the plurality of transport paths. In addition, it is not necessary to dispose a duct that guides the air to the plurality of transport paths from a fan. The flapper 217 is disposed in such a manner as to be capable of making contact with the transport guides 293 and 295, which are included in the transport path A. Thus, in the case where the flapper 217 is at the first position, at which the sheet transport path is switched to the punch path B, the flapper 217 can reduce the probability of the air W1 blown by the air-blowing fan 301 flowing into the bypass C. On the other hand, in the case where the flapper 217 is at the second position, at which the sheet transport path is switched to the bypass C, the flapper 217 can reduce the probability of the air W1 blown by the air-blowing fan 301 flowing into the punch path B. In this manner, air can be blown concentrically into only a transport path that requires the air among a plurality of transport paths by employing a simple configuration.

Second Embodiment

A feature of a second embodiment is a duct 305 that is provided in order to send air W2, which is blown by the air-blowing fan (air-blowing unit) 301 disposed outside the transport path, to a ventilation portion. The rest of the configuration and operation of the second embodiment are the same as those of the first embodiment, and descriptions thereof will be omitted.

Figure 11:
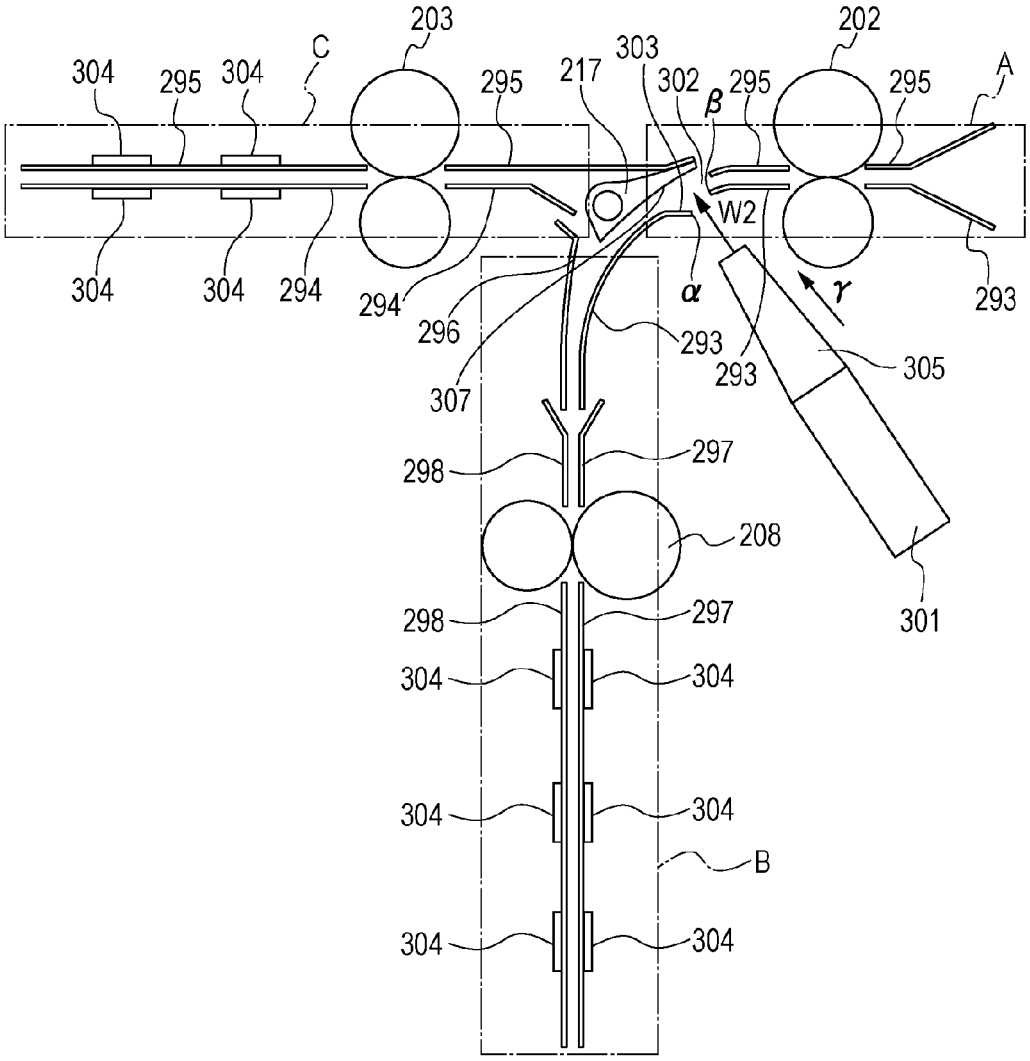
FIG. 11 is a diagram illustrating an air-blowing unit of a transport device according to a second embodiment (air flows into a punch path).
Figure 12:
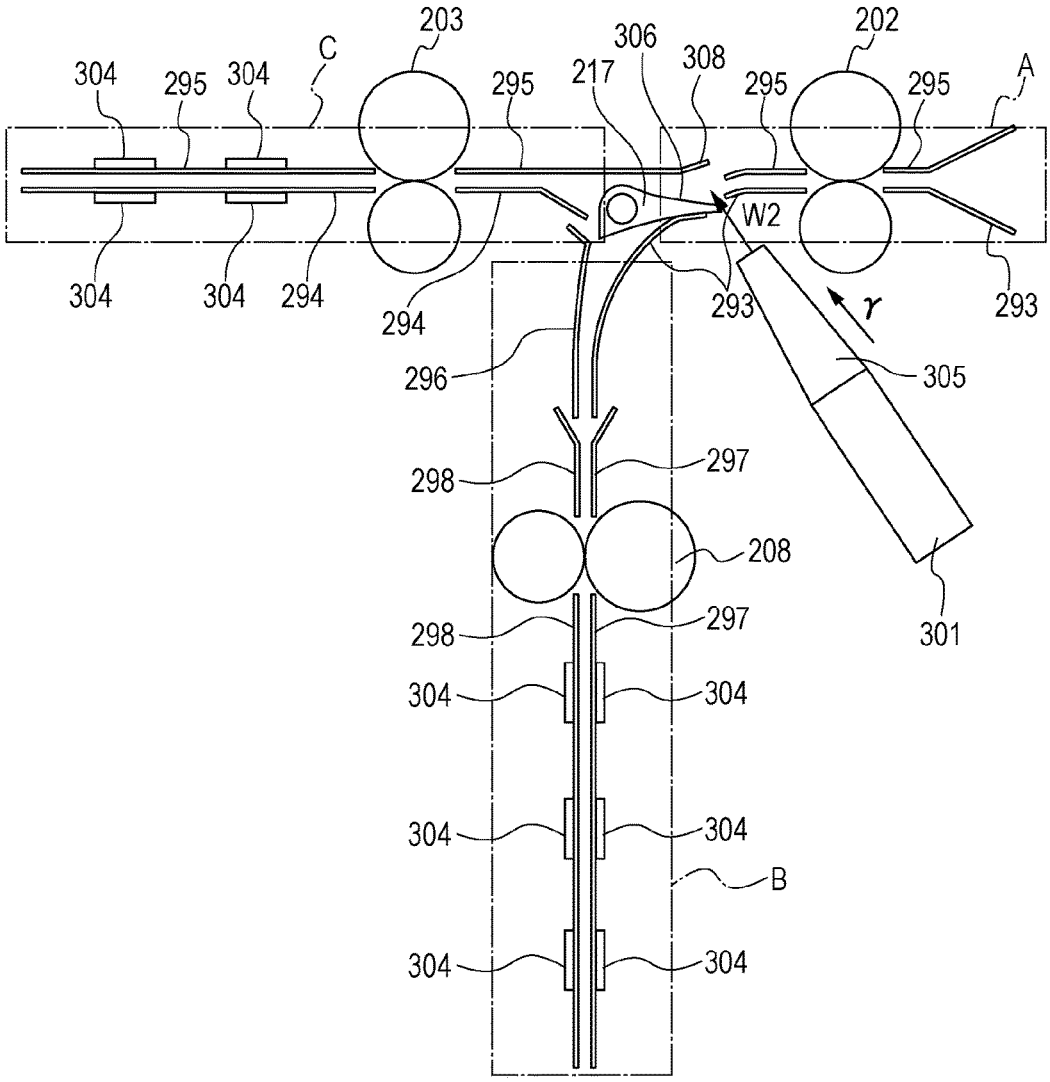
FIG. 12 is a diagram illustrating the air-blowing unit of the transport device according to the second embodiment (air flows into a bypass).

FIG. 11 and FIG. 12 are diagrams each illustrating the configuration of the air-blowing unit.

The transport path A includes the transport guides 293 and 295, which are the first guide portions. The punch path B includes the transport guides 293, 296, 297, and 298, which are the second guide portions. The bypass C includes the transport guide 294 and 295, which are the third guide portions.

The transport guide 293, which is the first guide portion, has the air-blowing hole (ventilation portion) 302 that is positioned further upstream than the flapper 217 in the sheet transport direction. In the second embodiment, a duct 305 that guides the air W2 blown by the air-blowing fan (air-blowing unit) 301 to the ventilation portion is provided. The air W2 that has passed through the duct 305 comes directly into contact with the flapper 217. Thus, the flapper 217 will be easily cooled by the air W2, and accordingly, the advantageous effect of cooling a sheet is improved.

FIG. 11 illustrates the case of the punching mode, and in FIG. 11, the sheet transport path has been switched to the punch path B by the flapper 217. As illustrated in FIG. 11, the air W2 blown by the air-blowing fan (air-blowing unit) 301, which is disposed outside the transport path A, passes through the air-blowing hole 302 and comes into contact with a lower portion of the transport surface 307 of the flapper 217. The top surface of the upstream end of the flapper 217 is in contact with the transport guide 295, and the air W2, which has been blown, is caused by the flapper 217 to flow only into the punch path B, that is, the air W2 is blown concentrically into the transport path used for transporting a sheet. Then, the air W2 is exhausted to outside the transport path from the exhaust holes (first exhaust ports) 304 formed in the transport guides 297 and 298. As a result, air containing steam discharged by a sheet in the transport path is exhausted to outside the transport path, and condensation is prevented from occurring.

FIG. 12 illustrates the case of the through mode, and in FIG. 12, the sheet transport path has been switched to the bypass C by the flapper 217. The bottom surface of the upstream end of the flapper 217 is in contact with the transport guide 293, and the air W2 blown by the air-blowing fan 301 will not flow into the punch path B and is blown concentrically into the bypass C used for transporting a sheet. Then, the air W2 is exhausted to outside the transport path from the exhaust holes 304 formed in the transport guides 294 and 295. As a result, air containing steam discharged by a sheet in the transport path is exhausted to outside the transport path, and condensation is prevented from occurring.

Others

Although the configuration of the transport device that performs switching between the punch path B in which the punching operation is performed and the bypass C in which the punching operation will not be performed has been described in the above embodiments, the present invention is not limited to this as long as a plurality of transport paths are provided. For example, one of the plurality of transport paths may be a transport path used for performing other processing, such as stapling processing. In addition, the present invention may be applied to a branch at which a two-side path, which is used for transporting a sheet that has passed through the fixing unit 904 to the image-forming unit again in order to form an image on the two surfaces of the sheet, and a one-side path, which is used in the case of not forming an image on the two surfaces of the sheet, branch.

Although the case of the image forming apparatus including the image-forming unit that employs an electrophotographic system has been described, the present invention is not limited to this. For example, the present invention can be applied to an image forming apparatus that performs image formation by ejecting ink and in which a transport path is to be cooled.

According to the present invention, in a sheet transport apparatus that includes a plurality of transport paths, air can be blown into the plurality of transport paths by employing a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-244173, filed Dec. 2, 2014, and No. 2015-207950, filed Oct. 22, 2015, which are hereby incorporated by reference herein in their entirety.

What is claimed is:

1. A sheet transport apparatus comprising:

a first guide portion that is included in a first transport path along which a sheet is to be transported;

a movable guide portion that is capable of moving to a first position at which the movable guide portion guides the sheet from the first transport path to a second transport path and to a second position at which the movable guide portion guides the sheet from the first transport path to a third transport path; and an air-blowing unit that blows air into the first transport path from outside the first transport path, wherein the first guide portion has a ventilation portion that is positioned further upstream than the movable guide portion in a sheet transport direction in which the sheet is to be transported, and the air-blowing unit blows the air into the first transport path from outside the first transport path via the ventilation portion, wherein an order of arrangement for components, in a direction relative to the air blown by the air-blowing unit is the air-blowing unit, the ventilation portion, the movable guide portion, and the second transport path or the third transport, path wherein the air blown by the air-blowing unit is selectively guided to the second transport path and the third transport path as a result of switching a position of the movable guide portion between the first position and the second position, and wherein the movable guide portion and the first guide portion are arranged in such a manner that the movable guide portion and the first guide portion are capable of coming into surface contact with each other when the movable guide portion is at the first position and the second position.

2. The sheet transport apparatus according to claim 1, further comprising:

a duct that guides the air blown by the air-blowing unit to the ventilation portion.

3. The sheet transport apparatus according to claim 1, wherein, when a portion of the first guide portion, which has the ventilation portion, on a downstream side in the sheet transport direction is a downstream portion, and a portion of the first guide portion on an upstream side in the sheet transport direction is an upstream portion, the downstream portion is positioned closer to the air-blowing unit than the upstream portion in a direction in which a flow path of the air extends, the air being blown by the air-blowing unit.

4. The sheet transport apparatus according to claim 1, wherein a surface of the movable guide portion and a surface of the first guide portion that come into contact with each other are plane surfaces.

5. The sheet transport apparatus according to claim 1, wherein the movable guide portion and the first guide portion come into contact with each other in a continuous manner in a direction perpendicular to the sheet transport direction.

6. The sheet transport apparatus according to claim 1, wherein a length of a surface with which the movable guide portion and the first guide portion come into contact with each other in a direction perpendicular to the sheet transport direction is equal to or larger than a maximum length of the sheet to be transported.

7. The sheet transport apparatus according to claim 1, wherein the movable guide portion is made of a material that has a thermal conductivity larger than a thermal conductivity of a material of a second transport guide that is included in the second transport path or a material of a third transport guide that is included in the third transport path.

8. The sheet transport apparatus according to claim 1, wherein the second transport guide, which is included in the second transport path, has a first exhaust port through which the air in the second transport path is exhausted, and wherein the third transport guide, which is included in the third transport path, has a second exhaust port through which the air in the third transport path is exhausted.

9. The sheet transport apparatus according to claim 1, wherein the movable guide portion is a flapper that has a rotation-supporting axis, which is positioned further downstream than the ventilation portion in the sheet transport direction.

10. The sheet transport apparatus according to claim 1, wherein processing is performed on the sheet that has been transported to second transport path.

11. The sheet transport apparatus according to claim 10, wherein the processing is punching to be performed on the sheet.

12. An image forming apparatus comprising:

an image-forming unit that forms an image on a sheet;

a first guide portion that is included in a first transport path along which the sheet is to be transported;

a movable guide portion that is capable of moving to a first position at which the movable guide portion guides the sheet from the first transport path to a second transport path and to a second position at which the movable guide portion guides the sheet from the first transport path to a third transport path; and an air-blowing unit that blows air into the first transport path from outside the first transport path, wherein the first guide portion has a ventilation portion that is positioned further upstream than the movable guide portion in a sheet transport direction in which the sheet is to be transported, and the air-blowing unit blows the air into the first transport path from outside the first transport path via the ventilation portion, wherein an order of arrangement for components, in a direction relative to the air blown by the air-blowing unit is the air-blowing unit, the ventilation portion, the movable guide portion, and the second transport path or the third transport path, wherein the air blown by the air-blowing unit is selectively guided to the second transport path and the third transport path as a result of switching a position of the movable guide portion between the first position and the second position, and wherein the movable guide portion and the first guide portion are arranged in such a manner that the movable guide portion and the first guide portion are capable of coming into surface contact with each other when the movable guide portion is at the first position and the second position.

* * * * *